US005577884A

United States Patent [19]

Mari

[11] Patent Number: 5,577,884

[45] Date of Patent: Nov. 26, 1996

[54] STRUCTURE FOR A STATIONARY COOLED TURBINE VANE

[75] Inventor: Christian Mari, Vaux le Penil, France

[73] Assignee: Societe Nationale d'Etude et de Construction de Moteurs d'Aviation S.N.E.C.M.A., Paris, France

[21] Appl. No.: 738,442

[22] Filed: Mar. 13, 1985

[30] Foreign Application Priority Data

Mar. 14, 1984 [FR] France ..... 84 03896

[51] Int. Cl.[6] ..... F01D 9/02

[52] U.S. Cl. ..... 415/115; 416/96 A; 416/97 R

[58] Field of Search ..... 416/97 A, 96 R, 416/96 A, 97 R; 415/115, 175; 60/39.36, 39.05; 428/554, 553

[56] References Cited

U.S. PATENT DOCUMENTS

| | | | |
|---|---|---|---|
| 3,606,572 | 9/1971 | Schwedland | 416/97 A |
| 4,364,160 | 12/1982 | Eiswerth | 416/96 R |
| 4,418,455 | 12/1983 | Cohn | 416/96 R |
| 4,440,834 | 4/1984 | Aubert et al. | 428/554 |
| 4,487,550 | 12/1984 | Horvath | 416/96 R |
| 4,545,197 | 10/1985 | Rice | 60/39.05 |

FOREIGN PATENT DOCUMENTS 2473621 5/1983 France .

*Primary Examiner*—Stephen C. Bentley
*Attorney, Agent, or Firm*—Bacon & Thomas

[57] ABSTRACT

An improved turbine vane structure is disclosed which enables more effective cooling and the reduction of temperature gradients along its length. The hollow interior of the vane is divided into three separate cavities, two upstream cavities and a downstream cavity. The downstream cavity is partially filled with a body of porous, heat transfer material. Cooling air flows through the downstream cavity in a direction counter to the hot gases passing over the exterior surface of the vane so as to increase the heat exchange properties. The two upstream cavities lie adjacent to each other and are supplied with cooling air from opposite directions to achieve a counterflow, heat exchange effect. Several sets of cooling holes are provided through the vane wall to communicate with the interior cavities and supply cooling air to the exterior surface of the vane.

18 Claims, 2 Drawing Sheets

STRUCTURE FOR A STATIONARY COOLED TURBINE VANE

BACKGROUND OF THE INVENTION

1. Field of the Invention

The instant invention relates to a stationary, cooled turbine vane having improved means for cooling the interior and exterior of the vane.

2. Brief Description of the Prior Art

Stationary vanes in turbine engines are typically located directly adjacent the outlet of the combustion chambers and are subject to very rigorous operating conditions. They are exposed to extremely high temperatures, repeated thermal shocks upon each change in operating condition and non-uniformities in the temperature that effect different zones of the vane (leading edge, concave face, convex face and trailing edge) to bring about internal stresses which accelerate the fatigue of the vane structure.

Cooling of the stationary turbine vanes is known and is generally accomplished by the circulation of air taken from the turbine compressor and directed onto the interior or exterior surfaces of the vanes. Air directed to the interior of the hollow vanes may exit through a plurality of cooling holes through the vane wall to form a protective cooling film along the exterior surfaces of the vane. The primary purpose of such cooling is to limit the maximum temperature reach by the vane material and to minimize the temperature gradient existing on different zones of the vane in order to reduce thermal stresses. At the same time, the cooling air taken from the compressor must be kept to a minimum in order to minimize the loss of efficiency of the compressor.

Various arrangements for promoting heat exchange between different zones of the vanes are known, such as the provision of studs, bridges, fins and flow spoilers inside the hollow vane cavity. An arrangement of this type is described in Franch patent 2,473,621. It is also known to provide a heat sink of a body of porous material in the interior of the vane such that it occupies all or a portion of the cavity. An example of such a porous body formed of metal shavings bound together by diffusion brazing is shown in U.S. Pat. No. 4,440,834 to Aubert et al. Although these known arrangements have proven generally satisfactory, they have not provided sufficient cooling of the vanes under all operating conditions.

SUMMARY OF THE INVENTION

The present invention provides a cooled, turbine vane in which heat transfer is improved with respect to the prior art devices. This objective is obtained by providing the hollow vane with interior partitions which divide the interior into three separate cavities: two upstream cavities; and a downstream cavity. A first partition wall extends from the interior of the leading edge of the vane to the concave face of the air foil-shaped cross-section and adjoins this concave face at its approximate bit point. A second partition wall extends from the first partition wall to the interior of the upper surface of the airfoil.

The downstream cavity is at least partially filled with a body of porous, heat transfer material in contact with a portion of the internal surface of the convex face and the first partition. Internal and external mounting platforms are attached to either end of the vane and serve as attaching devices for mounting the vane to the associated structure. The internal platform defines first and second orifices which allow cooling air to enter the first upstream cavity and the downstream cavity, respectively. The external platform defines a third orifice which allows cooling air to enter the second upstream cavity such that it passes in a counterflow relationship with the air entering the first upstream cavity. The external plate also defines a fourth orifice which allows air to exit from the downstream cavity after passing through the porous body. The primary direction of air flow within the downstream cavity is counter to the direction of flow of the heated gases passing over the exterior surfaces of the vane. This counterflow serves to increase the heat transfer between the hotter convex face of the vane to the colder concave face.

To further increase the heat transfer capabilities, the first and second partition walls may be formed with cooling fins and flow spoilers which protect into the upstream cavities. The second upstream cavity may also have flow spoilers located adjacent the leading edge of the vane to further increase the heat transfer and keep this portion of the vane at acceptable temperatures.

A plurality of cooling holes may be formed through the vane and communicate with the respective cavities. This allows the cooling air to pass through the cooling holes and to form a film of cooling air along the exterior surfaces of the vane.

The combination of these cooling elements make it possible to effectively limit the maximum temperature that can be obtained by the vane material and to minimize the temperature gradients between the various portions of the vane. This contributes to reducing the transient thermal inertia in the vane and to improve the transient temperature response thereby enabling the acceptance of a very high local gas temperature (up to 2000° C.). This is possible while at the same time increasing the life of the vanes due to a decrease in their thermal fatigue.

DETAILED DESCRIPTION OF THE PREFERRED EMBODIMENT

Figures 1, 4:
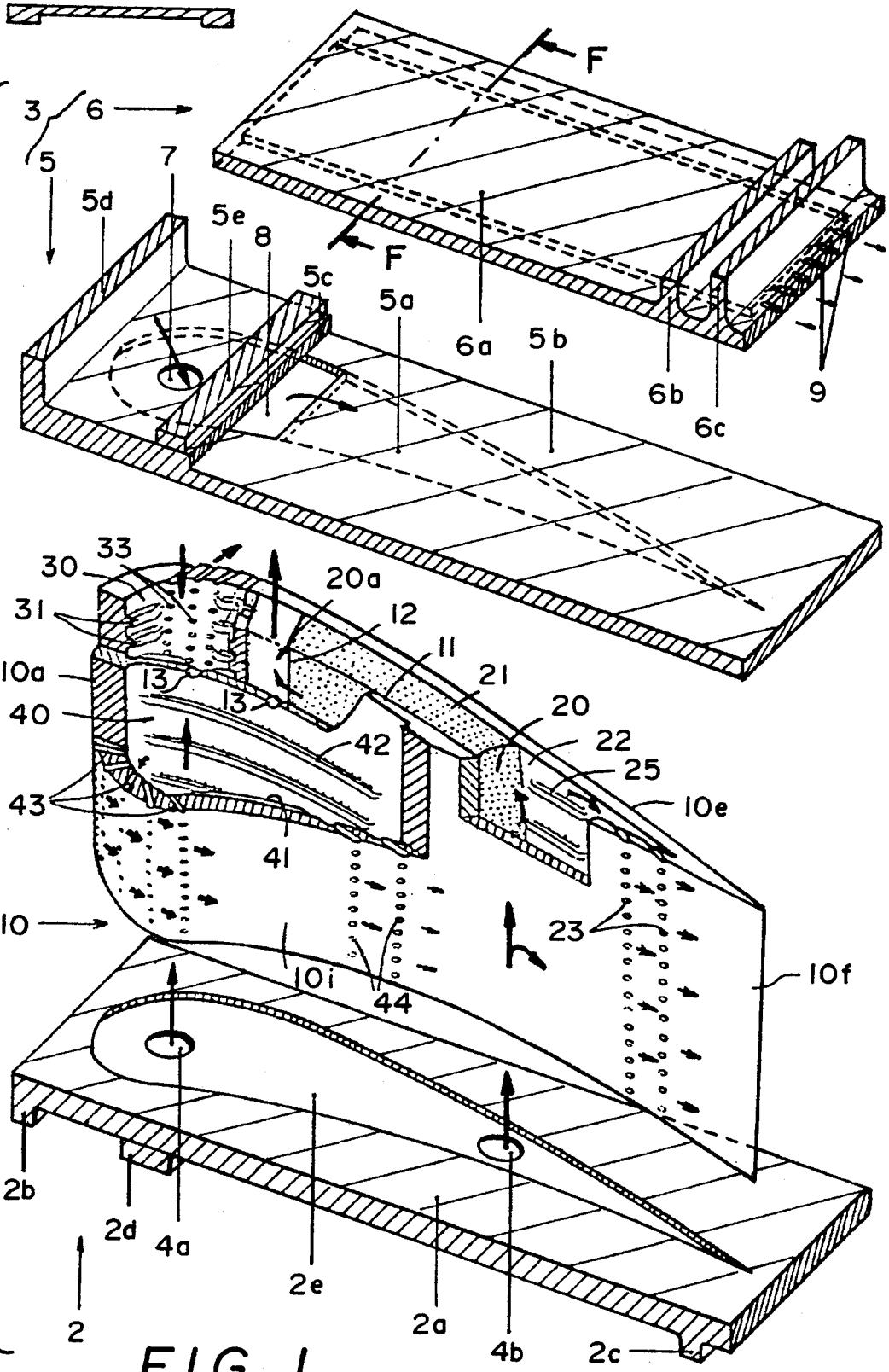
FIG. 1 is an exploded, perspective view, partially broken away, showing the turbine vane structure according to the invention.
FIG. 4 is a cross-sectional view taken along F—F in FIG. 1.

The vane assembly 1, shown in FIG. 1, comprises a hollow vane 10 having internal platform 2 attached to and covering a first end of the vane, and an external platform 3 attached to and covering the opposite end of the vane. Vane 10 is hollow and may be formed of cast metal by any of the many known casting techniques.

Internal platform 2 comprises a flat, plate portion **2*a*, the internal face of which has flanges 2*b*, 2*c* and stop 2*d*. The external face of plate 2*a* is formed with an impression 2*e* having the same airfoil shaped profile as the vane 10. The impression 2*e* may be formed by machining and may be equal to one-half the thickness of the plate 2*a*. The internal platform 2 defines a first orifice 4*a* and a second orifice 4*b* which pass through the plate 2*a* within the confines of the airfoil-shaped impression 2*e***.

External platform 3 comprises an assembly of two plates, elements 5 and 6 in FIG. 1. Plate 5 comprises on its internal face, an impression 5*a* which matches the airfoil shape of the vane 10. Plate 5 is attached to the end of vane 10 such that the airfoil-shaped vane enters the impression 5*a*. Plate 5*a* also defines two orifices: third orifice 7 and fourth orifice 8. Fourth orifice 8 is formed at the upstream end of reduced thickness portion 5*b*. The external platform 5 also comprises flange 5*d*, stop 5*e* and step 5*c* on its external face.

Figure 3:
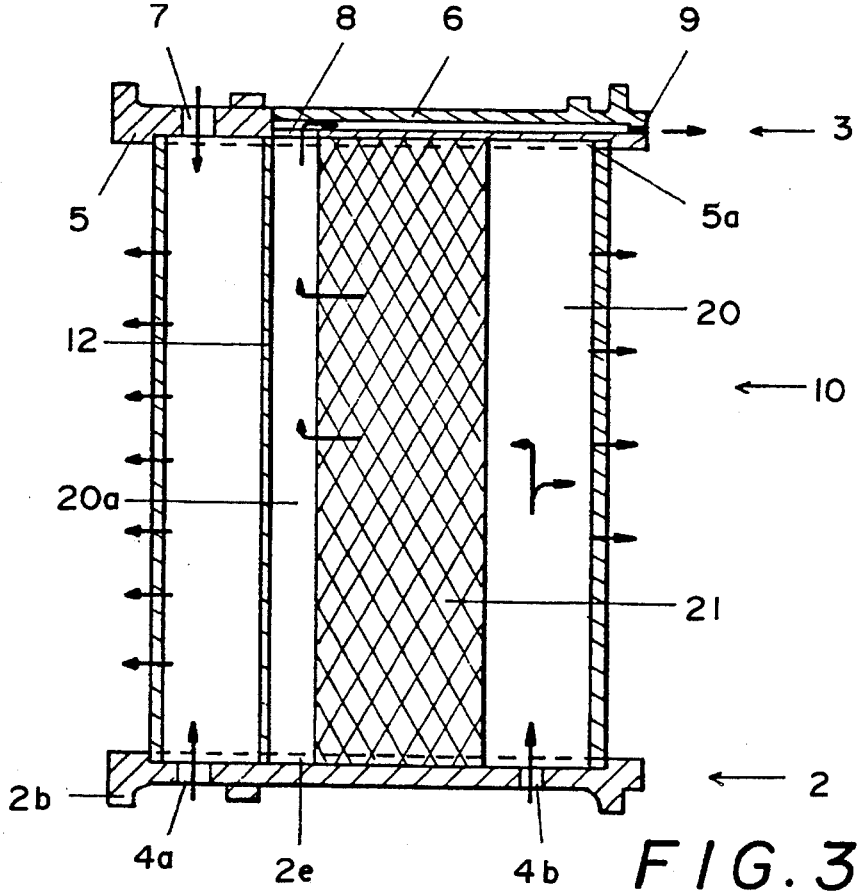
FIG. 3 is a sectional view taken along line A—A in FIG. 2.

External plate 6 is assembled with plate 5, as shown in FIGS. 1 and 3, such that exit cavity 6*a* is formed between them. The central portion of plate 6 has a reduced thickness portion to form the exit cavity 6*a* when the two plates are assembled. The cross-section of this plate is shown in FIG. 4. Its external face also has two flanges, 6*b* and 6*c* formed near the downstream edge portion. The downstream edge portion also defines a series of exit holes 9 which communicate with the exit cavity 6*a* to allow the cooling air to pass therethrough into a low pressure area.

The hollow interior of the vane 10 is divided into three cavities (20, 30 and 40) by first and second partition walls 11 and 12. The first and second partition walls may be formed integrally with the vane by any of the known casting or molding techniques. First partition wall 11 extends approximately in the direction of the chord of the airfoil-shaped cross-section of the vane 10 between the leading edge portion 10*a* and the approximate central portion of lower surface 10*i*. Second partition wall 12 extends generally transversely of the airfoil cross-section of vane 10 between the first partition wall 11 and the interior of the upper surface 10*e*. Second partition wall 12 may be located a distance from the leading edge portion of the vane equal to one-fourth the chord of the airfoil. This distance would also locate the transverse wall approximately one-third the total length of the first partition wall from the leading edge portion.

Downstream cavity 20 is delineated by the downstream three-fourths of upper surface 10*e*, second partition wall 12, the downstream two-thirds of first partition wall 11, and the downstream half of lower surface 10*i*. As shown in the figures, this downstream cavity 20 is located such that second orifice 4*b* communicates therewith so as to direct cooling air into the cavity. The means for withdrawing a portion of the air from the turbine compressor and supplying it to the various orifices are not shown in detail, since these elements are well known in the art.

Figure 2:
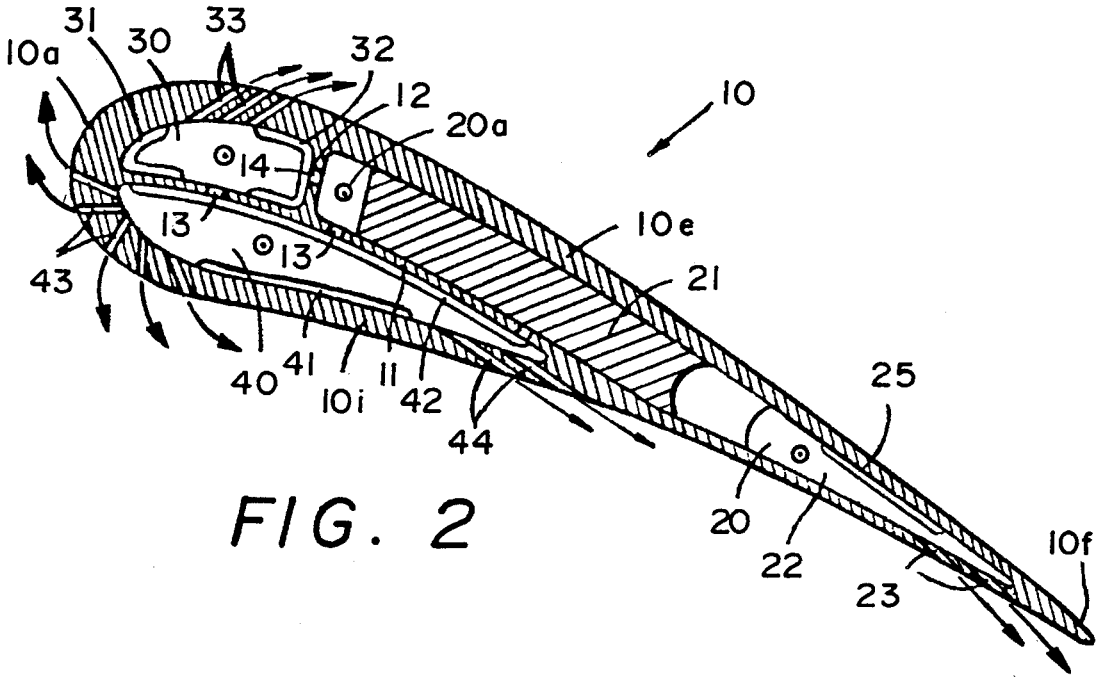
FIG. 2 is a cross-sectional view of the vane taken along line B—B in FIG. 1.

A body of porous material is located in the downstream cavity 20 between the second orifice 4*b* and the fourth orifice 8. The body of porous material extends the entire width of the cavity between first partition wall 11 and upper surface 10*e* as shown in FIG. 2. The porous body 21 may be formed of metal shavings bound together and to the walls of the cavity in which they are in contact by diffusion brazing. Such a process is shown in U.S. Pat. No. 4,440,834 to Aubert et al. The body of porous material 21 may be formed as shown, so as to leave a passage 20*a* between its upstream edge and the second partition wall 12. Alternatively, the porous material 21 may extend in an upstream direction so as to be in contact with the second partition wall 12. If the porous body extends so as to contact the second partition wall, it may also be attached thereto by the diffusion brazing process.

Free space 22 exists in downstream cavity 20 between the body of porous material 21 and the trailing edge 10*f* of the vane. Part of the air supplied to downstream cavity 20 enters free space 22 and passes through a plurality of cooling holes 23 formed in surface 10*i* of the vane 10. The air exiting these cooling holes forms a cooling film that protects the downstream portion of the lower surface 10*i* and the trailing edge 10*f*. Another portion of the air entering downstream cavity 20 passes through the body of porous material 21 in an upstream direction, counter to the flow of the hot gases passing over the surface of the vane 10. The air, once passing through the porous body 21, enters passage 20*a* and exits through fourth orifice 8 into exit cavity 6*a*. From this cavity, the air exits through the series of exit holes 9 into a zone of relatively low pressure and may be directed to contact the upstream face of the adjacent turbine ring so as to effect a cooling thereof. The pressure differential between passage 22 and the exit holes 9 make it possible for the air to flow through the porous body 21. Because of the nature of this material, a very high heat-transfer coefficient is achieved. The flow of heat from the lower, as well as the upper surface is directed toward the outside of the vane structure by the air flowing through the porous body.

Although the air flowing through fourth orifice 8 has been reheated, it is still able to cool the external platform 3. The reverse circulation of the air thus contributes to the establishment of effectively isothermal conditions in the vane 10, especially along upper surface 10*e*.

Longitudinal flow spoiler ribs 25 may be formed on the interior of upper surface 10*e* within downstream cavity 20 to improve the heat exchange between this part of the upper surface and the air circulating in passage 22.

Second upstream cavity 30 is delineated by the upstream portion of upper wall 10*e*, leading edge portion 10*a*, the upstream third of first partition wall 11 and the second partition wall 12. The interior of leading edge portion 10*a* and the upstream portion of first partition wall 11 may be fitted with flow spoiler fins 31 which extend inwardly into the second upstream cavity. Similar flow spoiler fins 32 are formed on the upstream side of the second partition wall 12 and adjacent portions of upper surface 10*e* and the first partition wall 11. These fins also extend into the second upstream cavity so as to increase the heat transfer capabilities. Cooling air passes through third orifice 7 into the second upstream cavity 30. The air may exit through a plurality of cooling holes 33, formed in several rows, extending over the height of the vane. Cooling holes 33 are oriented so as to direct the flow of air being discharged from them in a downstream direction to form a protective cooling film along the upper surface 10*e* of the vane. The air circulating through second upstream cavity 30 provides effective cooling of the leading edge 10*a* due primarily to the presence of fins 31.

Convection cooling of the internal portion of leading edge 10*a* can be accelerated by the installation of a perforated plate which extends radially in the vicinity of fins 31. This enables the air jets to impact on the internal wall of the leading edge between the fins 31.

First upstream cavity 40 is defined by the first partition wall 11, leading edge portion 10*a* and the upstream half of lower surface 10*i*. Longitudinal cooling fins 41 and 42 may be formed on lower surface 10*i* and first partition wall 11 so as to extend inwardly into first upstream cavity 40 to increase the heat transfer capabilities to the air passing through the cavity. Fins 41 have the additional function of radiating heat toward the first partition wall 11 from whence it will be evacuated by conduction in the second partition wall, whereby the cooling air flows through the porous body. Fins 42 on the first partition wall 11 also contribute to the cooling of the downstream cavity 20 by providing a heat sink through the first partition wall 11.

Cooling air passes into the first upstream cavity 40 through first orifice 4*a* in a direction counter to that passing into the second upstream cavity 30. This counterflow contributes to a reduction in the thermal gradient along the length of the vane.

A plurality of cooling holes 43 and 44 communicate with the first upstream cavity and provide an exit for the cooling air entering this cavity. Cooling holes 43 are located adjacent the leading edge portion 10*a* and are provided over the entire length of the vane. First upstream cavity 40 thus cooperates with second upstream cavity 30 to insure effective cooling of the exposed portion of leading edge 10*a*. Although five rows of such cooling holes 43 are shown, quite obviously any number may be utilized depending upon the operational parameters which are to be encountered. As noted, however, the holes 43 have different angles of inclination in order to direct a portion of the air flow toward upper surface 10*e* and a portion toward lower surface 10*i*. Cooling holes 44 also communicate with first upstream chamber 40 and serve to direct a portion of the air in a downstream direction to form a cooling film along the lower surface, 10*i* of the vane.

First and second partition walls 11 and 12 may be formed which a plurality of perforations 13 and 14 in order to permit communication between the various cavities.

The foregoing is provided for illustrative purposes only and should not be construed as in any way limiting this invention, the scope of which is defined solely by the appended claims.

What is claimed is:

1. In a turbine having at least one row of stationary vanes, the improved vane structure comprising:

a) a stationary vane having an airfoil cross-section with convex and concave faces, a leading edge portion and a trailing edge portion, the vane defining a hollow interior;

b) a first partition wall in the hollow interior of the vane extending generally from the leading edge portion to the concave face;

c) a second partition wall in the hollow interior of the vane extending from the first partition wall to the convex face so as to divide the hollow interior into a first upstream cavity, a second upstream cavity and a downstream cavity;

d) an internal mounting platform attached to and covering an interior end of the vane, the internal platform defining a first orifice to allow cooling air to enter the first upstream cavity and a second orifice to allow cooling air to enter the downstream cavity near the trailing edge portion of the vane;

e) an external mounting platform attached to and covering an exterior end of the vane, the external platform defining a third orifice to allow cooling air to enter the second upstream cavity and a fourth orifice communicating with the downstream cavity adjacent the second partition wall to allow cooling air to exit from the downstream cavity;

f) a first plurality of cooling holes defined by the vane and communicating with the first upstream cavity to allow cooling air to exit therefrom and cool a portion of the exterior surface of the vane;

g) a second plurality of cooling holes defined by the vane and communicating with the second upstream cavity to allow cooling air to exit therefrom so as to cool a portion of the exterior surface of the vane; and h) a body of porous material located in the downstream cavity between the second orifice and the fourth orifice, and extending between the convex face and the first partition wall.

2. The improved vane structure of claim 1 wherein the external mounting platform defines an exit cavity in communication with the fourth orifice and a plurality of exit holes communicating with the exit cavity to allow cooling air to exit therefrom.

3. The improved vane structure of claim 2 further comprising a plurality of cooling fins located on the first partition wall and extending into the first upstream chamber.

4. The improved vane structure of claim 3 further comprising a plurality of flow spoiler fins located on the second partition wall and extending into the second upstream cavity.

5. The improved vane structure of claim 4 wherein the second partition wall is attached to the upper surface a distance from the leading edge equal to approximately one-fourth the chord of the vane airfoil.

6. The improved vane structure of claim 5 wherein the first partition wall is attached to the concave face at the approximate mid-point of the latter.

7. The improved vane structure of claim 6 wherein the body of porous material comprises a bundle of diffusion bonded metal shavings.

8. The improved vane structure of claim 7 wherein the body of porous material is located so as to define a passage with the second partition wall, which passage communicates with the fourth orifice.

9. The improved vane structure of claim 8 further comprising a third plurality of cooling holes defined by the concave face of the vane so as to communicate with the downstream chamber downstream of the second orifice to allow cooling air to exit therefrom and cool a portion of the exterior surface of the vane.

10. The improved vane structure of claim 9 further comprising a plurality of perforations defined by the first and second partition walls and located such that the first and second upstream cavities, and the downstream cavity communicate with each other.

11. The improved vane structure of claim 1 further comprising a plurality of cooling fins located on the first partition wall and extending into the first upstream chamber.

12. The improved vane structure of claim 1 further comprising a plurality of flow spoiler fins located on the second partition wall and extending into the second upstream cavity.

13. The improved vane structure of claim 1 wherein the second partition wall is attached to the upper surface a distance from the leading edge equal to approximately one-fourth the chord of the vane airfoil.

14. The improved vane structure of claim 1 wherein the first partition wall is attached to the concave face at the approximate mid-point of the latter.

15. The improved vane structure of claim 1 wherein the body of porous material comprises a bundle of diffusion bonded metal shavings.

16. The improved vane structure of claim 1 wherein the body of porous material is located so as to define a passage with the second partition wall, which passage communicates with the fourth orifice.

17. The improved vane structure of claim 1 further comprising a third plurality of cooling holes defined by the concave face of the vane so as to communicate with the downstream chamber downstream of the second orifice to allow cooling air to exit therefrom and cool a portion of the exterior surface of the vane.

18. The improved vane structure of claim 1 further comprising a plurality of perforations defined by the first and second partition walls and located such that the first and second upstream cavities, and the downstream cavity communicate with each other.

* * * * *